United States Patent [19]

Dolan et al.

[11] Patent Number: 4,507,712

[45] Date of Patent: Mar. 26, 1985

[54] METHOD OF MAKING REPLACEABLE LAMP UNIT FOR AUTOMOTIVE HEADLIGHT

[76] Inventors: Richard J. Dolan, R.F.D. #1, Box 279, Bradford, N.H. 03221; Frank Cangiano, Rte. 2, Box 101, Hillsboro, N.H. 03244; John Van der Linde, R.F.D. #1, Box 6, Deering, N.H.

[21] Appl. No.: 507,393

[22] Filed: Jun. 24, 1983

[51] Int. Cl.[3] ..... F21M 3/30

[52] U.S. Cl. ..... 362/61; 362/80; 362/83; 362/226; 362/267; 362/306; 313/113

[58] Field of Search ..... 313/113, 622, 318, 623, 313/579; 362/61, 80, 83, 226, 267, 285, 158, 306; 339/102 R, 102 L, 155 L; 29/25.13, 25.15, 25.16, 25.19

[56] References Cited

U.S. PATENT DOCUMENTS 3,960,278 6/1976 Vause ..... 313/318
4,287,448 9/1981 Bradley ..... 313/318
4,310,772 1/1982 Tyler ..... 313/318
4,412,273 10/1983 Helbig ..... 362/267

*Primary Examiner*—Donald P. Walsh

[57] ABSTRACT

A method of making a replaceable lamp unit (10) for use within an automobile headlight. The method comprises the steps of providing three spaced apertures (29) within a wall (25) of a plastic holder (19), positively securing a metallic eyelet (27) within each aperture, attaching a metallic support wire (43) to each of at least two lead-in wires (31) of an electric lamp (39), inserting the support wires within each of the eyelets, and thereafter soldering (45) the support wires to the respective secured eyelets. Precise alignment of the envelope (33) of the electric lamp is provided prior to the soldering operation. The soldering operation assures not only a sound electrical connection, but also provides both a hermetic seal between eyelet and support wire components and a means for maintaining the lamp support wire sub-assembly in fixed position with the holder.

10 Claims, 3 Drawing Figures

METHOD OF MAKING REPLACEABLE LAMP UNIT FOR AUTOMOTIVE HEADLIGHT

TECHNICAL FIELD

The invention relates to automobile headlights and more particularly to those wherein a replaceable lamp unit assembly is utilized.

BACKGROUND

Automobile headlights wherein a replaceable lamp unit is employed are known in the art. Examples are illustrated in U.S. Pat. Nos. 3,688,103 (Daumuller), 3,593,017 (Cibie) and 2,750,491 (Anderson).

As stated, the instant invention is related to lamps of the variety described above and in particular defines a method of making a replaceable lamp unit which provides both a hermetic seal for the unit within the headlight's reflector and also assures that the electric lamp utilized therewith will be maintained in strict alignment as is necessary in automotive headlights. By the term hermetic seal is meant a seal which prevents the passage of moisture, dust and other elements which can adversely affect the operation of the headlight. By way of example, excessive moisture entering the headlight can adversely affect the reflective coating typically utilized on the concave reflector of the headlight, and thus significantly reduce light output.

In addition to providing a hermetic seal, the replaceable lamp unit defined herein assures that alignment of the electric lamp employed therewith will be maintained. That is, alignment of the glass envelope of the lamp relative to the unit's holder is provided such that the filament structure therein (either a singular coiled filament or two, spaced coiled filaments) will be accurately aligned relative to the optical axis of the reflector when the lamp unit is oriented within the reflector's rear opening.

As also described herein, a preferred light source which constitutes an important part of the replaceable lamp unit defined herein is an electric lamp of the tungsten halogen variety. One example is shown in U.S. Pat. No. 3,829,729 (Westlund, Jr. et al), said patent assigned the same assignee as the instant invention. In tungsten halogen lamps, the tungsten which constitutes the filament material is normally evaporated from the filament during lamp operation and combines with the halogen to form a gaseous halide, said halide preventing the tungsten from depositing on the internal wall of the lamp's glass envelope. Upon returning to the filament structure, the halide decomposes, resulting in the deposition of tungsten back onto the filament structure and the release of additional halogen gas to assure continuation of the cycle. The halogen cycle is well known in the art, and lamps employing it have been used for some time. In the case of the two beam (dual filament) lamp, a typical tungsten halogen lamp provides about 65 watts when operated at high beam and about 35 watts at low beam. Understandably, it is critical that the filament structure of the lamp within an automobile headlight be aligned relative to the reflector to provide optimum output of the finished headlight. As will be described below, such alignment constitutes an important feature of the replaceable lamp unit defined herein.

DISCLOSURE OF THE INVENTION

It is an object of the instant invention to enhance the automobile headlight art and more particularly to enhance that portion of the art wherein electric lamps such as those of the tungsten halogen variety are utilized.

It is another object of the invention to provide a method of making a replaceable lamp unit for use within an automobile headlight which provides a hermetic seal for the electric lamp positioned therein and also maintains said lamp in a fixed relationship relative to the holder thereof.

It is yet another object of the invention to provide a method of making a replaceable lamp unit, which method can be implemented in a relative inexpensive manner readily adapted to mass production.

In accordance with one aspect of the invention, there is defined a method of making a replaceable lamp unit which in turn forms part of an automobile headlight. The method comprises the steps of providing at least two spaced apart apertures within a wall member of an electrically insulative holder, fixedly securing an electrically conductive member within each aperture, fixedly securing each of at least two metallic support wires to a respective one of the two lead-in wires of the electric lamp (said lamp also including an envelope from which the lead-in wires project), inserting the support wires within a respective one of the electrically conductive members, and thereafter providing an electrical connection between each of the support wires and the conductive members. The described electrical connections provide both a hermetic seal between the conductive members and respective support wires while at the same time serving to maintain the electric lamp in a substantially fixed position within the insulative holder.

BEST MODE FOR CARRYING OUT THE INVENTION

For a better understanding of the present invention together with other and further objects, advantages and capabilities thereof, reference is made to the following disclosure and appended claims in connection with the above-described drawing.

Figure 1:
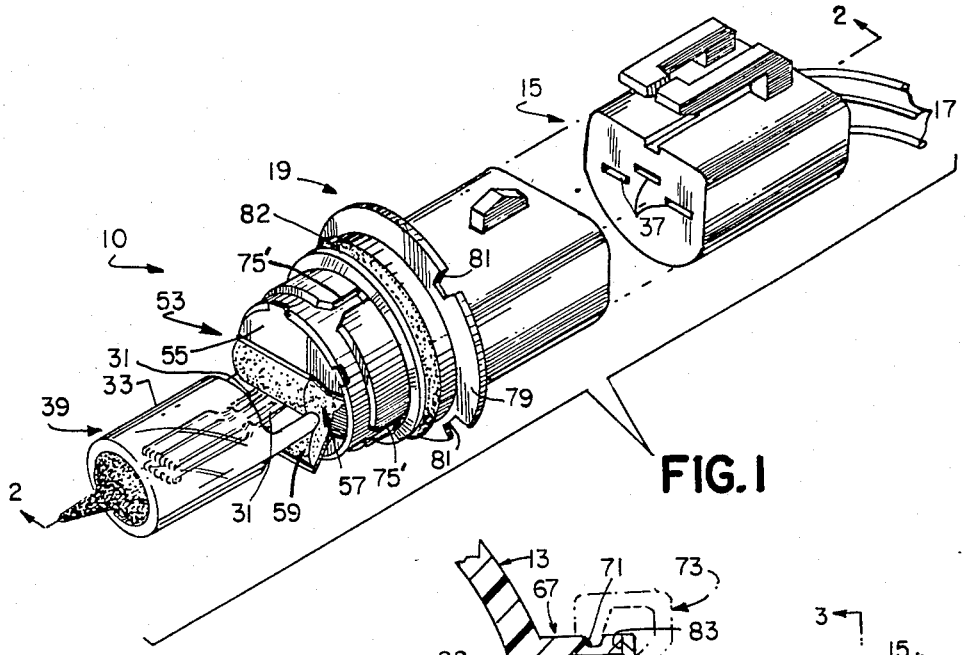
FIG. 1 represents an exploded perspective view of a replaceable lamp unit made in accordance with the teachings herein.

With particular attention to FIG. 1, there is illustrated in a perspective view a replaceable lamp unit 10 made in accordance with the teachings herein, said unit capable of being removably positioned within the rear opening 11 (FIG. 2) of a reflector 13 (FIG. 2) which forms part of an automobile headlight. Lamp unit 10 is further designed for being electrically connected to an external connector 15 which comprises part of the electrical circuitry of the automobile employing the headlight. Specifically, connector 15 is designed for being inserted within the rear portion of unit 10 after the unit has been positioned within the reflector's opening. Connector 15 includes a plurality of electrical wires 17 which also form part of the automobile's circuit. Wires 17 are thus either directly or indirectly connected to the power source (e.g., 12-volt battery) typically found in most automobiles.

Unit 10 includes an electrically insulative holder 19 which defines therein a first cavity 21 and a second cavity 23, said cavities separated by a common wall member 25. Holder 19 is comprised of a heat and impact resistant plastic (e.g., preferably polyphenylene sulfide) and is thus readily suitable for use within the relatively harsh environment typically found about automobile headlights.

Figure 2:
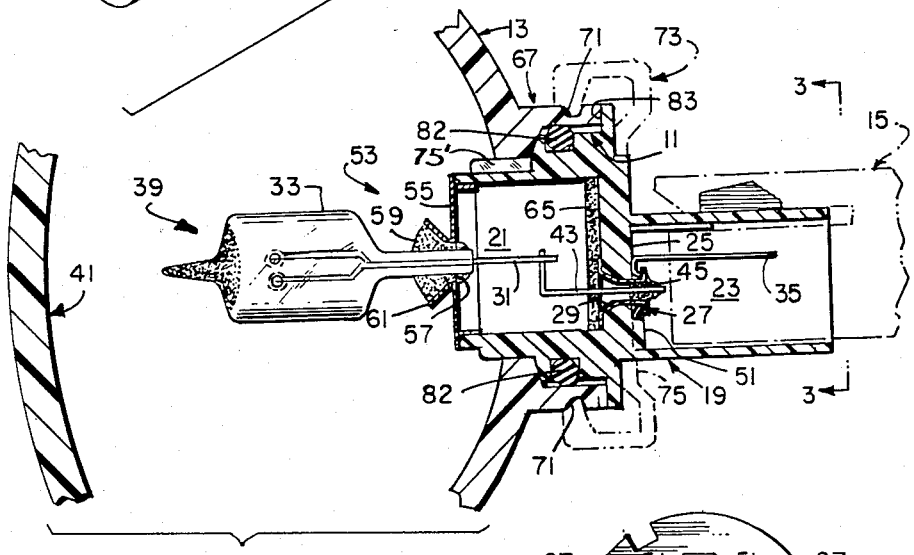
FIG. 2 is a side elevational view, in section, of the replaceable lamp unit in FIG. 1 on a larger scale and further illustrating automobile headlight reflector and lens members which form part of an automobile headlight in which the unit can be utilized.

Unit 10 further includes at least two electrically conductive members 27 which are each fixedly secured within a respective one of a similar number of apertures 29 (one shown in FIG. 2) located within wall member 25. It is understood that a minimum of two apertures and corresponding electrically conductive members 27 are utilized in the instant invention. In one embodiment, three members 27 (and apertures 29) were utilized when holder 19 accommodated a dual filament tungsten halogen lamp. Typically, tungsten halogen lamps including a dual coil filament structure therein (such as shown in FIG. 2) include at least four lead-in wires 31 (only one shown in FIG. 2) which project externally from the glass envelope 33 of the lamp. In the case of a single coil tungsten filament lamp, only two lead-in wires 31 are typically utilized. It is thus understood that holder 19 is adapted for accommodating both single and double coil filament tungsten halogen lamps.

Each of the electrically conductive members 27 is preferably in the form of a conical shaped metal eyelet. A preferred material for each eyelet is tin-plated brass. Other suitable metals include aluminum, copper, steel, and nickel-iron alloy.

Electrically connected to each eyelet is a metallic lug member 35 which includes a base segment positioned firmly against wall 25 (FIG. 2) and an upstanding leg segment which extends within second cavity 23. Accordingly, each of the lug members 35 (a total of three are shown in the drawing) is designed for being inserted within a corresponding opening 37 of external connector 15 to provide electrical connection therewith when the connector is inserted within cavity 23.

As stated, holder 19 is adapted for accommodating an electric lamp (39) which is preferably of the tungsten halogen variety. When in final position within opening 11 of reflector 13, the envelope 33 of lamp 39 extends within the reflector and is substantially surrounded by the reflecting surfaces thereof in such a manner so as to provide optimum light output from the headlight (said headlight further including a forward lens member 41 designed for directing light in a predetermined pattern from the assembled unit). Understandably, alignment of envelope 33 relative to the reflective surfaces of reflector 13 such that the filament structure contained therein is precisely oriented relative to the reflector's optical axis is deemed critical to assure optimum light output. Accordingly, it is essential that lamp 39 be initially oriented relative to holder 19 in a fixed relationship therewith such that when the holder is positioned within opening 11 of reflector 13, this critical alignment is attained. Such precisioned alignment constitutes an important feature of the instant invention, in addition to the provision of the aforementioned hermetic seal.

In FIG. 2, each of the lead-in wires 31 is shown projecting from envelope 33 into the first cavity 21 of holder 19. Positively secured (e.g., by welding) to the lead-in wires in a predetermined manner are a plurality of rigid support wires 43, each of said wires of L-shaped configuration and extending within (passing through) a corresponding one of the metallic eyelets 27. Each of these support wires is preferably of 0.080 inch diameter nickel-plated steel, although it is of course understood that other metals could be utilized. Attachment of each support wire 43 to a respective one of the conductive eyelets is achieved by soldering such that a quantity of solder 45 flows within the hollow eyelet and effectively surrounds the support wire centrally disposed therein. One example of a suitable solder for use in the invention is a 30/70 tin-lead composition. Other compositions suitable for use herein include a 60/40 tin-lead composition, and a 20/80 tin-lead composition. The solder, in addition to providing a sound electrical connection between the eyelet and support wire, also assures the defined hermeticity at this portion of the connection by virtue of its complete filling of the illustrated end portion of the eyelet. It also serves to rigidly maintain the support wire in a fixed position relative to holder 19 such that the corresponding lamp 39 will be maintained in the substantially fixed position shown. This constitutes yet another significant feature of the invention in that positive positioning of the lamp (particularly the envelope 33 and corresponding filament structure therein) is assured. It is understood that support wires 43 constitute extensions of the lead-in wires 31 to which they are attached. In effect, these members thus form part of the lead-in wire-lamp assembly. Accordingly, it is within the scope of this invention to provide lead-in wires 31 of greater length, subject these to various bending operations (to form the configurations depicted in FIG. 2), and insert the ends thereof within respective eyelets 27, thus eliminating the need for support wires 43 as defined herein. In such an arrangement, these lead-in wires would assure the necessary rigid support function required in the invention.

To provide effective connection between the respective lug members 35 and corresponding conductive eyelets 27, a mechanical operation is utilized. Specifically, a projecting end segment of each of the metallic eyelets is crimped over the leg portion of the respective lug member which rests against wall 25. Because the eyelet includes a flange portion at the opposing end thereof (against an opposing surface of wall 25), this crimping operation in effect draws the eyelet positively within the corresponding conical-shaped aperture 29. The result, therefore, is that a seal is provided between each eyelet and corresponding aperture. The defined crimping operation, as stated, functions to provide the essential electrical connection between lug and eyelet components.

Figure 3:
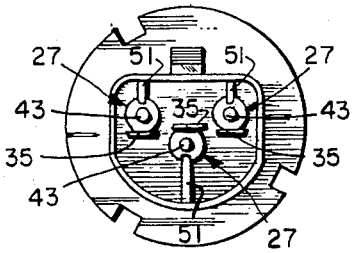
FIG. 3 is an end elevational view of the replaceable lamp unit of FIG. 2 as taken along the line 3—3 in FIG. 2.

During assembly of lamp unit 10, alignment of each of the lug members 35 is deemed important such that said members will be properly oriented within the respective apertures 37 of connector 15. To thus provide this alignment within the second cavity 23, a plurality of upstanding rib members 51 are provided. Each rib member 51 may form part of or be a separate member located on wall 25 of holder 19, such as shown in FIG. 3. Accordingly, each of the lug members 35 includes an indentation therein designed for aligning with a respective rib member 51 to achieve the orientation depicted.

Replaceable lamp unit 10 further includes means 53 for engaging envelope 33 of lamp 39 when the lamp is positioned within holder 19. This engagement means serves to assist in maintaining lamp 39 in the defined fixed position. Means 53 preferably comprises a metallic retainer 55 which is frictionally inserted within an end of holder 19 (to in effect provide a partial enclosure for the first cavity 21). Retainer 55 is preferably stainless steel and includes an elongated slot 57 therein, said slot designed for having the press-sealed end of envelope 33 positioned substantially therein. A quantity of cement 59 is used to interconnect the retainer 55 and the portions of the external surfaces of envelope 33 located in this region. Retainer 55 includes a projecting flange portion 61 located relative to (about) slot 57 to thus enhance accommodation of cement 59. A preferred cement for use herein is Saureisen, a known basing cement in the lamp industry.

To further assure an effective hermetic seal in the portion of holder 19 wherein there are positioned the several conductive members and support wires of the invention, a quantity of sealant material 65 (FIG. 2) is added. Sealant material 65, as shown, is located along the opposite surface of wall 25 from the surface engaged by lug members 35 and serves to cover each of the eyelets 27 in the manner indicated. In addition, sealant 65 surrounds each of the support wires 43 projecting within the respective eyelets to thus also assure a seal therebetween. A preferred sealant material for use herein is epoxy. Examples of other sealants for use herein include epoxy-urethanes, urethanes, polyesters, acrylics, synthetic rubbers, silicone rubbers, polyamides, phenolics, acrylates, hot melts, polycarbonates, polystyrenes and silicone molding powders, to name a few.

As shown in FIG. 2, reflector 13 includes a projecting neck portion 67 which extends from the rear portion of the reflector and is located about opening 11 (that is, opening 11 extends through the circumferential neck 67). Located within the exterior surfaces of neck portion 67 are a plurality of grooves 71. To further assist in retaining holder 19 within opening 11, a removable cap member 73 (shown in phantom in FIG. 2) is utilized. Cap 73 is adapted for being positioned within (engaging) the corresponding grooves 71 and includes a resilient base segment 75 designed for engaging an external surface of holder 19. Base segment 75 is resilient to allow flexure thereof during engagement with holder 19 to prevent lamp misalignment as a result of said engagement. Positioning of holder 19 within reflector 13 is accomplished merely by aligning corresponding slots 75' (FIG. 1) within the external surface of the holder with corresponding male protruberances (not shown) which are spacedly located about the reflector opening 11. Holder 19, having lamp 39 fixedly positioned therein in the manner defined above, is thus merely directly inserted within reflector 13 to the depth indicated in FIG. 2. There is thus no need for rotational-type movement of the holder in order to secure its final position within reflector 13. Thereafter, cap member 73, including a large central orifice (not shown) adapted for passing over the exterior surfaces of the rear portion of holder 19, is simply screwed onto the upstanding neck portion 67 of reflector 13. Retention of cap 73 is further assured by provision of an upstanding flange 79 on holder 19 wherein there are included at least two recesses 81 (FIG. 1). A similar number of projecting segments (not shown) which form part of the cap are designed for passing through each of these recesses 81 after which the cap is rotated a short distance to effect locking.

To further assure a sound hermetic seal between the exterior surfaces of holder 19 and the corresponding internal surface of opening 11, a rubber O-ring 82 is provided. As shown in FIG. 2, O-ring 82 is positioned within a corresponding groove or slot within the holder's external surface and projects slightly thereabove. Accordingly, a compression fit is provided between the outermost edge of the O-ring and the corresponding internal surfaces of opening 11.

In accordance with the teachings of the instant invention, assembly of lamp unit 10 is accomplished firstly by providing the insulative holder 19 with the desired number (e.g., 3) of apertures 29 within the wall member thereof. Within each aperture is inserted one of the electrically conductive eyelets 27 having the defined hollow, conical configuration. Each of the corresponding metallic lug members is then positioned (inserted) within holder 19 through the rear thereof (that portion surrounding the second cavity 23). With the base or lower portion of the lug member located substantially about the conical-shaped eyelet, the end of the eyelet is mechanically deformed by spinning, flattening, peening, or the defined crimping operation onto the base portion of the lug such as shown in FIG. 2. A positive mechanical and electrical connection between the eyelets and respective lug terminals is thus provided. Either before or subsequent the above operation, the defined support wires 43 are welded to designated lead-in wires 31 projecting from envelope 33. This sub-assembly (envelope, lead-in wires, and support wires) is then positioned within the opposing (forward) end of holder 19 such that the support wires extend within the first cavity 21 and further within the hollow portion of the respective conductive eyelets 27. It is thus understood that the above crimping operation does not serve to close the hollow eyelet and thus prohibit support wire insertion. With the support wires in place within the respective eyelets 27, the envelope 33 of lamp 39 is oriented relative to a fixed surface (i.e., surface 83 of the insulative holder 19) such that the corresponding coiled filament(s) located within the envelope are positioned an established distance from this reference surface. In addition, the envelope is also oriented such that the filament structure is precisely located relative to the central axis (not shown) of the substantially cylindrical shaped holder 19. When positioned within rear opening 13, this central axis coincides with the reflector's optical axis to thus assure that the lamp's filament structure will be positively aligned relative to the reflector's internal reflective surfaces.

With the lamp positively aligned relative to holder 19, the described soldering operation is performed such that the support wires 43 are positively retained in a fixed manner within the corresponding eyelets 27. Additional solder is also provided to overflow the crimped ends of each eyelet and contact portions of the retained lug members 35. The solidified solder, as described, not only provides the described effective electrical connection between support wire and respective eyelet, but also provides an effective hermetic seal at this portion of the connection.

Subsequent to the above soldering operation, the described sealant 65 is poured within the forward end of holder 19 to occupy the position along wall 25 as indicated. Preferably, sealant 65 is added in liquid form and thus requires curing thereof subsequent to its positioning within the holder. Curing is attained by exposing the sealant to an established temperature within the range of about 200° to about 300° F. for a period of approximately one hour. In one example, the sealant was heat cured for the period of one hour at a fixed temperature of 250° F. Understandably, the entire assembly, including lamp, holder, and respective conductive members, is exposed to this elevated temperature with no adverse side effects.

Subsequent to the above curing operation, the described retainer 55 is frictionally positioned within the forward end of holder 19. The described cement 59 is then added to the flanged portion 61 of the retainer ring 55 and thereafter cured in place. Curing is accomplished by exposing the cement to an elevated temperature of about 250° F. for a period of about one hour. Curing of cement 59 completes the necessary steps of making the replaceable lamp unit 10 as shown and defined herein.

There has thus been shown and described a method of making a replaceable lamp unit for use within an automobile headlight wherein the unit provides both a hermetic seal between the electric lamp used therein and the holder, in addition to an effective means of maintaining alignment of the lamp in fixed relationship to the holder. With the replaceable lamp unit 10 in position within the reflector (13) of an automobile headlight (FIG. 2), the filament structure of the electric lamp used therein is precisely oriented relative to the reflective surfaces of the reflector and the optical axis thereof.

We claim:

1. A method of making a replaceable lamp unit which forms part of an automobile headlight wherein said lamp unit includes an electrically insulative holder, said method comprising:

providing at least two spaced apart, substantially conical-shaped apertures within a wall member of said insulative holder;

positioning a substantially conical-shaped electrically conductive member within each of said apertures;

mechanically connecting each of said conductive members to a respective metallic lug member, said mechanical connecting positively drawing each of said conductive members within said apertures in such a manner so as to seal each of said conductive members within a respective one of said apertures, said mechanical connecting further providing a positive electrical connection between each of said conductive members and a respective one of said metallic lug members;

fixedly securing each of at least two metallic support wires to a respective one of at least two lead-in wires of an electric lamp, said lamp further including an envelope from which said lead-in wires project;

inserting each of said support wires an established distance within a respective one of said electrically conductive members sealed within said apertures of said holder; and providing an electrical connection between each of said support wires and said conductive members, each of said electric connections between said support wires and said conductive members providing both a hermetic seal between said electrically conductive members and said respective support wire positioned therein and also serving to maintain said electric lamp in a substantially fixed position within said insulative holder.

2. The method according to claim 1 wherein each of said lug members is mechanically connected to a respective one of said conical-shaped conductive members by crimping.

3. The method according to claim 1 wherein each of said metallic support wires is fixedly secured to a respective one of said lead-in wires by welding.

4. The method according to claim 1 wherein each of said electrical connections between said support wires and said electrically conductive members is accomplished by soldering, said solder at least partly filling an end of each of said conductive members and surrounding each of said support wires located therein.

5. The method according to claim 1 further including the step of providing a layer of sealant material within said holder, said sealant material substantially covering each of said electrically conductive members secured within said apertures of said holder.

6. The method according to claim 5 wherein said sealant is applied in liquid form, said method further including the step of heat curing said sealant by exposing said sealant to an established temperature for a predetermined time period.

7. The method according to claim 6 wherein said established temperature is within the range of about 200° Farenheit to about 300° Farenheit and said time period is about one hour.

8. The method according to claim 1 further including the step of aligning said envelope of said electric lamp relative to said holder prior to providing said electrical connection between each of said support wires and said electrically conductive members.

9. The method according to claim 8 further including the step of positioning a retainer member within an end of said insulative holder in engagement with said envelope of said electric lamp subsequent to providing said electrical connection between said support wires and said electrically conductive members and to providing said alignment of said envelope.

10. The method according to claim 9 wherein said retainer member includes a slot therein, said method further including the step of positioning a quantity of cement within said slot in contact with said retainer member and substantially about said envelope.

* * * * *